US011827314B2

(12) United States Patent
Liu et al.

(10) Patent No.: US 11,827,314 B2
(45) Date of Patent: Nov. 28, 2023

(54) HYBRID DYNAMICALLY INSTALLED ANCHOR WITH A FOLDING SHANK AND CONTROL METHOD FOR KEEP ANCHOR VERTICALITY DURING FREE FALL IN WATER

(71) Applicant: DALIAN UNIVERSITY OF TECHNOLOGY, Liaoning (CN)

(72) Inventors: Jun Liu, Liaoning (CN); Congcong Han, Liaoning (CN); Xu Wang, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 505 days.

(21) Appl. No.: 17/260,128

(22) PCT Filed: Feb. 17, 2020

(86) PCT No.: PCT/CN2020/075530
§ 371 (c)(1),
(2) Date: Jan. 13, 2021

(87) PCT Pub. No.: WO2021/163842
PCT Pub. Date: Aug. 26, 2021

(65) Prior Publication Data

US 2021/0362810 A1 Nov. 25, 2021

(51) Int. Cl.
*B63B 21/24* (2006.01)
*B63B 21/36* (2006.01)
*B63B 21/26* (2006.01)

(52) U.S. Cl.
CPC ..... *B63B 21/243* (2013.01); *B63B 21/24* (2013.01); *B63B 21/26* (2013.01); *B63B 21/36* (2013.01); *B63B 2021/265* (2013.01)

(58) Field of Classification Search
CPC ..... B63B 21/24; B63B 21/243; B63B 21/246; B63B 21/26; B63B 21/265; B63B 21/29; B63B 21/34; B63B 21/36
See application file for complete search history.

(56) References Cited

U.S. PATENT DOCUMENTS 6,941,885 B2 * 9/2005 Zimmerman ..... B63B 21/26 114/294
7,059,263 B1 * 6/2006 Zimmerman ..... B63B 21/29 114/301

(Continued)

FOREIGN PATENT DOCUMENTS

CN 102176132 A 9/2011
CN 102177065 A 9/2011

(Continued)

OTHER PUBLICATIONS

Liu; "Numerical Simulation Of The Installation Of Gravity Installed Plate Anchors In Water;" The Ocean Engineering; vol. 35 No. 3; 1005-9865( 2017) 03-0029-08; May 2017; (pp. 8).

(Continued)

*Primary Examiner* — Ajay Vasudeva
(74) *Attorney, Agent, or Firm* — MUNCY, GEISSLER, OLDS & LOWE, P.C.

(57) ABSTRACT

The present invention relates to a hybrid dynamically installed anchor with a folding shank and a control method to keep the verticality of the hybrid anchor during free fall in the seawater, which can be applied to the field of offshore engineering. The hybrid anchor comprises a folding-shank plate anchor, a ballast shaft, an extension rod, a plurality of rear fins, and a recovery hole from the front to the tail. The folding shank is not only useful in reducing the water and soil resistance during installation, but also beneficial in improving the directional stability of the hybrid anchor during free fall in the seawater. The re-used shaft can (Continued)

significantly increase the penetration depth of the folding-shank plate anchor and reduce the installation cost at the same time. The control method keeping the verticality of the hybrid anchor can improve the success rate during anchor installation.

7 Claims, 9 Drawing Sheets

(56) References Cited

U.S. PATENT DOCUMENTS 7,878,137 B2 * 2/2011 De Medeiros J nior ..... B63B 21/50 114/295
10,384,746 B2 * 8/2019 Liu ..... B63B 21/26
2008/0141922 A1 * 6/2008 Muehlner ..... B63B 21/243 114/294
2013/0160694 A1 * 6/2013 Lieng ..... B63B 21/26 114/304
2019/0016417 A1 1/2019 Barrett

FOREIGN PATENT DOCUMENTS

CN 108725701 A 11/2018
CN 208149556 U 11/2018
CN 111301610 A 6/2020
WO WO-2006055963 A2 5/2006

OTHER PUBLICATIONS

Han; "Model Tests On The Penetration Depth Of Gravity Installed Plate Anchors;" The Ocean Engineering; vol. 34 No. 5; Sep. 2016; 1005-9865( 2016) 05-0092-09; (pp. 9).

* cited by examiner

HYBRID DYNAMICALLY INSTALLED ANCHOR WITH A FOLDING SHANK AND CONTROL METHOD FOR KEEP ANCHOR VERTICALITY DURING FREE FALL IN WATER

FIELD OF THE INVENTION

The present invention relates to a hybrid dynamically installed anchor with a folding shank and a control method to keep the verticality of the hybrid anchor during free fall in the seawater, which can be applied to the fields of offshore engineering and ocean engineering.

BACKGROUND OF THE INVENTION

Anchoring foundations are widely used to secure floating structures, which are applied to offshore industries such as oil and gas exploration, renewable energy, and floating bridges. Recently, the anchoring foundations applied to ocean engineering include piles, suction caissons, drag installed anchors, and suction embedded plate anchors. The drag installed anchor and suction embedded plate anchor can be considered as plate anchors. The capacity-to-weight efficiency (i.e. the ratio of the holding capacity to the dry weight of the anchor) of a plate anchor is relatively high, because the anchor is primarily subjected to normal resistance provided by the seabed soil surrounding the anchor. The aforementioned anchoring foundations are installed with the aid of pile hammers, suction pumps, and tugs. Moreover, the installation cost increases drastically with increasing seawater depths. Therefore, a new anchoring solution, cost-effective and time-efficient, should be proposed.

The dynamically installed anchor, which is abbreviated as 'DIA', is proposed recently to be applied to offshore engineering. The DIA is a self-installed anchoring foundation, which is released from a pre-determined height above the seabed before falling freely in the seawater and impacting the seabed. The DIA is dynamically installed within the seabed through its kinetic energy gained during free fall in the seawater and gravitational energy. After dynamically installation, the DIA is used to resist the uplift loading through the resistance provided by the surrounding soil. Overall, the DIA is cost-effective and time-efficient for installation.

Two types of DIAs, the torpedo-shaped one (U.S. Pat. No. 7,878,137B2) and the plate-shaped one (U.S. Pat. No. 7,059,263B1), have been applied to offshore engineering. The torpedo-shaped DIA is comprised of a semi-ellipsoidal or conical tip, a cylindrical shaft, and a plurality of rear fins. The cylindrical shaft can be ballasted with concrete and scrap metal to increase the total weight of the anchor, which ensures the anchor to achieve enough penetration depth within the seabed without additional loads. The rear fins are used to improve the directional stability of the anchor during free fall in the seawater. For the torpedo-shaped DIA, the padeye is located at the tail of the anchor. Therefore, the holding capacity is primarily provided by the sliding resistance at the anchor-soil interface, which results in a relatively low capacity-to-weight efficiency. The plate-shaped DIA is comprised of three sets of flukes, which are separated by 120 degrees in plan. Each set of fluke includes a larger top fluke and a smaller tip fluke. A loading arm, which can rotate freely around the central shaft of the anchor, is set between the top and tip flukes. The padeye is located at the outside of the loading arm. The symmetry of the plate-shaped DIA is deteriorated due to the deviation of the loading arm from the central shaft, which is unfavorable for the directional stability of the anchor during free fall in the seawater. The plate-shaped DIA will be subjected to a pull load in the upward direction due to the mooring line connected at the padeye, hence the anchor tip tends to rotate towards the padeye. This is unfavorable for the verticality of the anchor during free fall in the seawater. In addition, both the torpedo-shaped and plate-shaped DIAs are suitable for clayey seabed, and their penetration depths in sandy seabed are limited.

There has been, therefore, a longstanding need for a new anchor that combines the self-installation of DIAs with the high capacity-to-weight efficiency of plate anchors. There has also been a need for keeping the directional stability of the new anchor during free fall in the seawater. Moreover, there has also been a need for ensuring the new anchor to achieve enough penetration depth and gain enough holding capacity in varied seabed sediments, including clay, silt, sand and sandwiched soils. Besides, the verticality of a DIA during free fall in the seawater is a key factor for anchor installation, which is affected by the pull load by the mooring line, the underground current, the sway of the installation vessel, and many other factors. If the DIA tilts from the vertical direction during free fall in the seawater, the anchor cannot perpendicularly penetrate into the seabed and even results in failure installation. Therefore, there has also been a need for a control method which is used to keep the verticality of the DIA during free fall in the seawater.

SUMMARY OF THE INVENTION

A hybrid dynamically installed anchor with a folding shank is provided in the present invention. Also provided is a control method to keep the verticality of a DIA during free fall in the seawater.

In the following, the technical solution of the invention is clearly stated.

1. Hybrid Dynamically Installed Anchor with a Folding Shank

The present invention relates to a hybrid dynamically installed anchor with a folding shank, or simply 'hybrid anchor' for short, which owns the advantages including efficient installation, high success rate in installation, high capacity-to-weight efficiency, and suitable for varied seabed soils. The hybrid anchor comprises a folding-shank plate anchor, a ballast shaft, an extension rod, a plurality of rear fins (including a plurality of plate rear fins and an arched rear fin), and a recovery hole from the front end to the tail end. The folding-shank plate anchor is used to provide holding capacity to resist the uplift loading transmitted by the mooring line. The ballast shaft is used to encourage the folding-shank plate anchor to achieve enough penetration depth in the seabed. The extension rod and rear fins are used to improve the directional stability of the hybrid anchor during free fall in the sea water.

The folding-shank plate anchor is mainly comprised of a fluke, a shank, a support, and a connecting bar.

The fluke is a symmetric triangular-shaped or peltate-shaped plate. The apex of two symmetric sides of the triangular-shaped plate or the tip of the peltate-shaped plate is termed as the 'tip of the folding-shank anchor', which is helpful in reducing the drag force and soil resistance on the hybrid anchor during free fall in the seawater and dynamic penetration in the seabed. Therefore, the fall velocity and penetration depth of the hybrid anchor are increased during free fall in the seawater and dynamic penetration in the seabed. The thickness of the fluke gradually decreases from the central line to the outer edge of the fluke, which results in a decrease of the frontal area of the hybrid anchor in a plane that is perpendicular to the central line of the hybrid anchor. This is beneficial in increasing the penetration depth of the hybrid anchor in the seabed. The edges of the fluke are round-grinded to reduce the drag force on the hybrid anchor during free fall in the seawater, which helps to increase the fall velocity of the hybrid anchor during free fall in the seawater and increase the penetration depth in the seabed.

The support is fixed on the central line of the fluke, whose position can be adjusted along the central line of the fluke.

The shank has first and second ends: the first end is hinged to the support through a pivot shaft, and the second end is free. A padeye is set at the second end of the shank to connect the mooring line. The shank is further fixed to the support by a shear pin (a). When the shear pin (a) is intact, the shank is folded and is parallel to the central line of the fluke. When the shear pin (a) is broken under the pullout load at the padeye, the shank will rotate around the pivot shaft. The maximum rotation angle from the central line of the shank to that of the fluke is 90 degrees. The rotation of the shank is unidirectional, i.e. the shank only rotates to an orientation outwards from the fluke. A braking device should be set between the shank and the pivot shaft. For instance, a one-way bearing can be installed between the shank and the pivot shaft, so that the second end of the shank only rotates to an orientation outwards from the fluke. The shank is folded when the hybrid anchor falls in the seawater and penetrates in the seabed to decrease water drag force and soil resistance. The folded shank is also helpful in improving the directional stability of the hybrid anchor during free fall in the seawater. A pull load in the upward direction, provided by the mooring line, will be acted on the padeye when the hybrid anchor falls in the seawater. The design of the folding shank is helpful in reducing the distance from the padeye to the central line of the hybrid anchor, hence the moment generated by the pull load of the mooring line relative to the gravity center of the hybrid anchor is significantly reduced. This is beneficial in improving the directional stability of the hybrid anchor during free fall in the seawater. Overall, the folding shank has the advantages of increasing the penetration depth in the seabed and improving the directional stability of the hybrid anchor during free fall in the seawater. When the shear pin (a) is broken under the uplift load acting on the padeye, the shank can rotate around the pivot shaft. The unfolding process of the shank will increase the projected area of the folding-shank plate anchor in the plane perpendicular to the uplift load at the padeye. The failure mechanism of the soil surrounding the folding-shank plate anchor gradually translates to normal failure mechanism, which results in the increase of the holding capacity.

The connecting bar is fixed at the tail of the fluke, whose central line is coincide with that of the fluke. The connecting bar is used to connect the ballast shaft.

The ballast shaft is mainly comprised of a semi-ellipsoidal tip, a cylindrical mid-shaft, and a circular-truncated-cone shaped tail. The ballast shaft is used to increase the total weight of the hybrid anchor, which helps to increase the fall velocity of the hybrid anchor during free fall in the seawater and penetration depth in the seabed. The tip and top ends of the cylindrical mid-shaft are set with external threads, and corresponding internal threads are set on the semi-ellipsoidal tip and circular-truncated-cone shaped tail. The three parts, semi-ellipsoidal tip, cylindrical mid-shaft, and circular-truncated-cone shaped tail, are connected sequentially by threads. The cylindrical mid-shaft of the ballast shaft has varied lengths to adjust the total weight of the hybrid anchor based on the seabed strength, so that the hybrid anchor achieves enough penetration depth in the seabed. The cylindrical mid-shaft of the ballast shaft is fabricated with hollow structure to fill high density materials (such as lead) in order to increase the total weight of the hybrid anchor. The semi-ellipsoidal tip of the ballast shaft has an axial slot to accommodate the connecting bar of the folding-shank plate anchor. The semi-ellipsoidal tip of the ballast shaft further has a horizontal hole (a), and the connecting bar of the folding-shank plate anchor further has a horizontal hole (b). A shear pin (b) is sealed in the horizontal hole (a) and the horizontal hole (b) to connect the ballast shaft and the folding-shank plate anchor.

The extension rod has a cylindrical profile, whose cross section in size is the same with that of the minimum cross section of the circular-truncated-cone shaped tail of the ballast shaft. The extension rod is connected at the tail of the ballast shaft. At the tail of the extension rod, a recovery hole is set to connect the retrieval line. The extension rod is fabricated from light-weight metal or plastic, and is further fabricated with hollow structure to lower the gravity center of the hybrid anchor. The extension rod enlarges the distance from the rear fins to the tip of the folding-shank plate anchor to improve the directional stability of the hybrid anchor during free fall in the seawater. The length of the extension rod can be adjusted based on practical requirements. For instance, a longer extension rod is required in the clayey seabed in order to avoid buckling failure of the rear fins during the dynamic penetration process of the hybrid anchor in the seabed.

The rear fins are connected towards the rear of the extension rod and below the recovery hole. The rear fins further comprise a plurality of plate rear fins and an arched rear fin. Each plate rear fin is a quadrilateral thin plate. The upper edge of the plate rear fin is perpendicular to the central line of the extension rod, and the height of the plate rear fin reduces from the inner side to the outer side. The plate rear fins are fabricated from light-weight metal or plastic to lower the gravity center of the hybrid anchor. The least number of the plate rear fins is 3, and a plurality of plate rear fins are attached towards the rear of the extension rod to improve the directional stability of the hybrid anchor during free fall in the seawater. The directional stability of the hybrid anchor is further improved by enlarging the width of the plate rear fin.

The arched rear fin is connected between two pieces of plate rear fins in an orientation opposite the shank. During free fall in the seawater, the moment generated by the drag force on the arched rear fin relative to the gravity center of the hybrid anchor balances the moment generated by the drag force on the mooring line connected to the padeye relative to the gravity center of the hybrid anchor, so that the verticality of the hybrid anchor during free fall in the seawater is ensured. The radius and radian of the arched rear fin are associated with the material and diameter of the mooring line, the release height of the hybrid anchor in the seawater and many other factors. Hence the size of the arched rear fin should be adjusted based on practical requirements.

The central lines of the extension rod, the ballast shaft, and the folding-shank plate anchor are collinear. The gravity center of the hybrid anchor should be lower than the hydrodynamic center of the hybrid anchor to keep directional stability during free fall in the seawater.

Accordingly, a method for installing the hybrid anchor, which includes the following five steps.

step-1, fix the shank to the support by the shear pin (a), and connect the folding-shank plate anchor and the ballast shaft by the shear pin (b); then release the hybrid anchor from the installation vessel to the seawater until a pre-determined height above the seabed, and then release the mooring line to the seabed; and keep the hybrid anchor steady in the seawater until the sway amplitude of the hybrid anchor is stable;

step-2, release the retrieval line connected at the recovery hole to allow the hybrid anchor to fall in the seawater and penetrate into the seabed;

step-3, tension the retrieval line connected at the recovery hole after the dynamic installation of the hybrid anchor, and the shear pin (b) is broken when the shear force exceeds the allowable shear force of the shear pin (b) to allow separation between the ballast shaft and the folding-shank plate anchor; and further tension the retrieval line to retrieve the ballast shaft and the other parts (including the extension rod, the rear fins and the recovery hole) above the ballast shaft to the installation vessel, and only the folding-shank plate anchor is left in the seabed;

step-4, tension the mooring line connected at the padeye, and the shear pin (a) is broken when the shear force exceeds the allowable shear force of the shear pin (a); then the shank rotates around the pivot shaft;

step-5, further tension the mooring line connected at the padeye to enlarge the rotation angle from the central line of the shank to that of the fluke, and the fluke starts to rotate in the seabed until the pullout load reaches the designed load.

The allowable shear force of the shear pin (b) is 1.5~2.0 times the dry weight of the folding-shank plate anchor. The shear pin (b) should provide enough shear force to ensure that the folding-shank plate anchor is not separated from the ballast shaft during the release process of the hybrid anchor in the seawater. Moreover, the shear pin (b) should be easily to break when retrieving the ballast shaft, during which the folding-shank plate anchor is not pulled out together with the ballast shaft. The ballast shaft and the other parts above the ballast shaft are re-usable for subsequent installation of folding-shank plate anchors. The reusable design of the ballast shaft and the above parts only not ensures the folding-shank plate anchor to achieve enough penetration depth in the seabed, but also lowers the fabrication cost. In an anchoring system, all the folding-shank plate anchors can be installed by only using one ballast shaft.

2. Control Method for Keeping Verticality of Hybrid Anchor During Free Fall in Seawater An active-control system is proposed in the present invention to keep the verticality of the hybrid anchor during free fall in the seawater. The active-control system comprises an equipment chamber, an active-control unit, an electric motor, an actuator, and a mini-plate. The equipment chamber further comprises a cylindrical shaft and a thin-wall cylinder fixed outside the cylindrical shaft, and the central line of the cylindrical shaft coincides with that of the thin-wall cylinder. The thin-wall cylinder has a cycle of annular gap located at the middle height of the thin-wall cylinder. The bottom of the equipment chamber is connected to the tail of the hybrid anchor by threads, and the top of the equipment chamber has a recovery hole (n) to connect the retrieval line.

The active-control unit is sealed inside the cylindrical shaft of the equipment chamber, comprising an accelerometer module, a gyroscope module, a micro-controller, and a driver module. The accelerometer module and the gyroscope module measure accelerations and angular velocities of the hybrid anchor during free fall in the seawater. The micro-controller calculates the tilt angle from the central line of the hybrid anchor to the vertical direction in real time and makes adjustment solutions based on the measurements from the accelerometer module and the gyroscope module, and then sends the adjustment solution to the driver module.

The electric motor is connected to the active-control unit, which forces the actuator to move based on the command from the driver module.

The actuator comprises an axial sub-actuator, an annular sub-actuator, and a rotational sub-actuator. The annular sub-actuator is fixed to the cylindrical shaft of the equipment chamber. The axial sub-actuator has first and second ends, and the first end of the axial sub-actuator is fixed to the annular sub-actuator. The central line of the axial sub-actuator is perpendicular to that of the equipment chamber. The rotational sub-actuator is fixed to the second end of the axial sub-actuator.

The mini-plate is fixed to the rotational sub-actuator, whose position is flush with the annular gap located at the middle height of the thin-wall cylinder. The electric motor acts under the command of the driving module and adjusts the positions and postures of the mini-plate through the actuator. There has three motion states for the mini-plate, including a translation along a direction perpendicular to the central line of the hybrid anchor, a rotation around the central line of the hybrid anchor, and a rotation around the central line of the mini-plate itself. The axial sub-actuator makes the mini-plate to move along a direction perpendicular to the central line of the hybrid anchor, the annular sub-actuator makes the mini-plate to rotate around the central line of the hybrid anchor, and the rotational sub-actuator makes the mini-plate to rotate around the central line of the mini-plate itself. The mini-plate is not exposed outside of the thin-wall cylinder of the equipment chamber when the loading displacement of the axial sub-actuator is zero, hence the mini-plate is not subjected to drag force when the hybrid anchor falls in the seawater. The mini-plate stretches out from the annular gap of the thin-wall cylinder when the axial sub-actuator moves, then the mini-plate is subjected to drag force when the hybrid anchor falls in the seawater. The drag force on the mini-plate can be used to adjust the verticality of the hybrid anchor during free fall in the seawater.

Accordingly, a control method to keep verticality of the hybrid anchor during free fall in the seawater by using the active-control system, comprising the following steps:

(1) screw the active-control system to the tail of the hybrid anchor; the accelerometer module and the gyroscope module measure the accelerations and angular velocities of the hybrid anchor during free fall in the seawater in real time; and the micro-controller calculate the tilt angle from the central line of the hybrid anchor to the vertical direction in real time based on acceleration data from the accelerometer module and angular velocity data from the gyroscope module;

(2) the micro-controller makes adjustment solution to the driver module when the tilt angle from the central line of the hybrid anchor to the vertical direction exceeds a pre-determined threshold value; and the electric motor acts under the command of the driving module and adjusts the positions and postures of the mini-plate through the actuator;

(3) the mini-plate moves and rotates under the control of the actuator, and is subjected to drag force when the hybrid anchor falls in the seawater, and a moment is generated by the drag force on the mini-plate relative to a gravity center of the hybrid anchor, which forces the central line of the hybrid anchor to adjust to the vertical direction;

(4) the active-control system monitors the tilt angle from the central line of the hybrid anchor to the vertical direction and drives the mini-plate to move and rotate in real time in order to ensure the verticality of the hybrid anchor during free fall in the seawater.

Advantages of the Invention

The hybrid anchor in the present invention combines the self-installation of DIAs with the high capacity-to-weight ratio of plate anchors. The folding shank is not only helpful in reducing the drag force and soil resistance when the hybrid anchor falls in the seawater and penetrates in the seabed, but also beneficial in improving the directional stability of the hybrid anchor during free fall in the seawater. Attributed to the plate-shaped fluke and the folding shank, the failure mechanism of the soil surrounding the folding-shank plate anchor is predominated by the normal failure mechanism. This is helpful in improving the holding capacity of the folding-shank plate anchor. The reusable design of the ballast shaft and the above parts only not ensures the folding-shank plate anchor to achieve enough penetration depth in the seabed, but also lowers the fabrication cost. With the aid of the ballast shaft, the folding-shank plate anchor can be installed in varied seabed conditions, such as clay, silt, sand, and sandwiched soils. The arched rear fin is efficient in improving the directional stability of the hybrid anchor during free fall in the seawater. The active-control system and the corresponding active-control method can improve the success rate of installing a hybrid anchor, which can be further used to rectify the verticality for other types of DIAs. Overall, the present invention relates to a hybrid dynamically installed anchor and a control method to keep verticality of the DIA, which are beneficial in reducing the installation cost and improving the holding capacity for DIAs.

1 Folding-shank plate anchor; 2 Ballast shaft; 3 Shear pin (b); 4 Extension rod; 5 Rear fin; 5*a* Plate rear fin; 5*b* Arched rear fin; 6 Recovery hole; 7 Mooring line; 8 Retrieval line; 9 Active-control system; 11 Fluke; 12 Shank; 13 Support; 14 Pivot shaft; 15 Shear pin (a); 16 Padeye; 17 Connecting bar; 18 Horizontal hole (b); 19 Shank rotation angle; 21 Cylindrical mid-shaft; 22 Semi-ellipsoidal tip; 23 Circular-truncated-cone shaped tail; 24 Axial slot; 25 Horizontal hole (a); 91 Equipment chamber; 92 External threads; 93 Active-control unit; 94 Electric motor; 95 Actuator; 95*a* Axial sub-actuator; 95*b* Annular sub-actuator; 95*c* Rotational sub-actuator; 96 Mini-plate; 97 Recovery hole (n); 100 Hybrid anchor; 101 Hybrid anchor without recovery hole; 102 Hybrid anchor with an active-control system; 200 Torpedo-shaped DIA; 201 Torpedo-shaped DIA without recovery hole; 202 Torpedo-shaped DIA with an active-control system; 300 Installation vessel; M1 Translational movement; M2 Circumferential rotation motion; M3 Rotational movement.

DETAILED DESCRIPTION OF THE INVENTION

For illustrative purposes, some of the presently preferred embodiments of the invention will now be described, with reference to the drawings.

1. Hybrid Dynamically Installed Anchor with a Folding Shank

Figure 1:
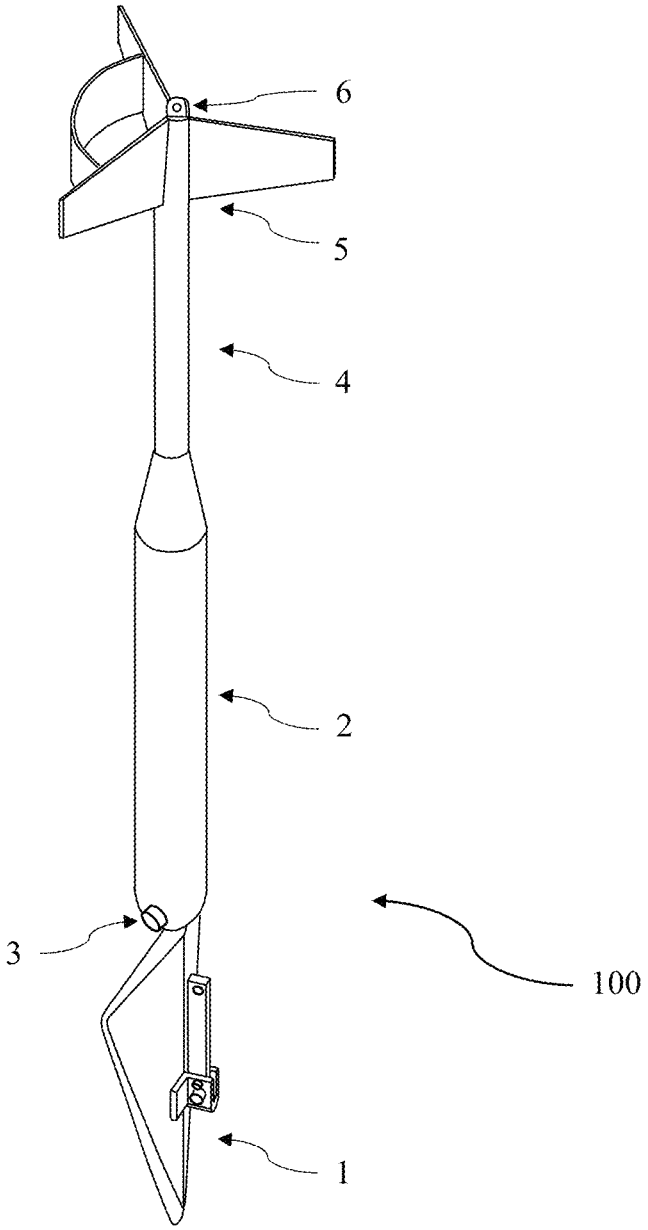
FIG. 1 shows a hybrid dynamically installed anchor with a folding shank.

FIG. 1 shows the key structural elements of the hybrid anchor 100, comprising a folding-shank plate anchor 1, a ballast shaft 2, an extension rod 4, a plurality of rear fins 5 (including a plurality of plate rear fins 5*a* and an arched rear fin 5*b*), and a recovery hole 6 from the front end to the tail end.

Figure 2:
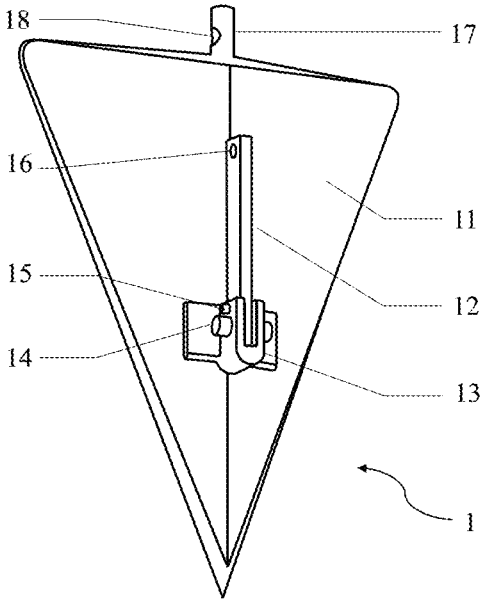
FIG. 2 shows a folding-shank plate anchor whose shank is folded.
Figure 3:
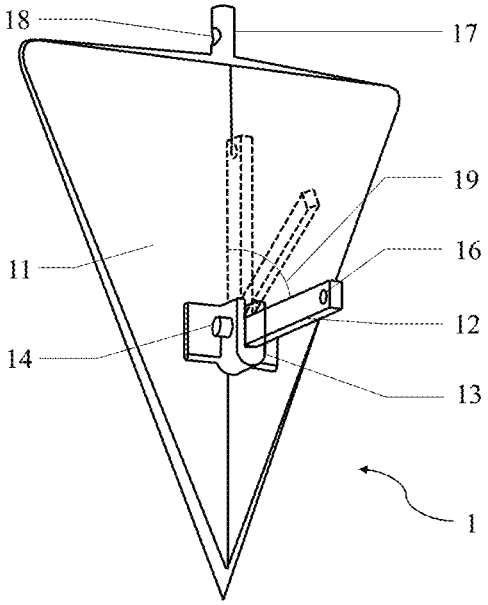
FIG. 3 shows a folding-shank plate anchor whose shank is unfolded.
Figure 4:
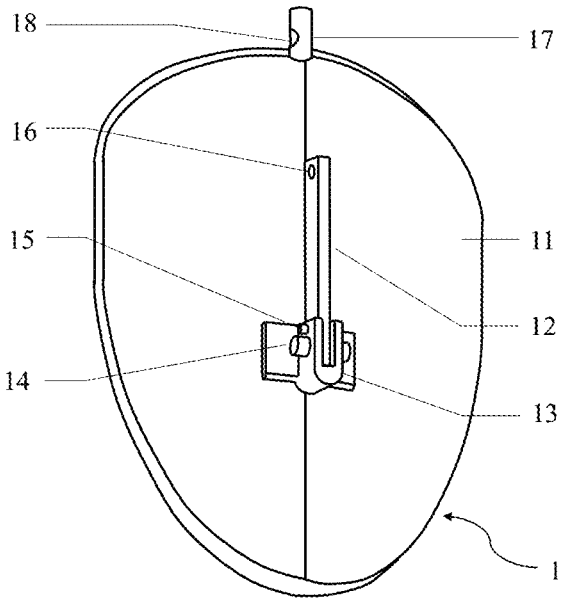
FIG. 4 shows a folding-shank plate anchor featuring a peltated-shaped fluke.

FIGS. 2-4 show the key structural elements of the folding-shank plate anchor 1, which is further mainly comprised of a fluke 11, a shank 12, a support 13 using to accommodate the shank, and a connecting bar 17.

The fluke 11 is a symmetric triangular-shaped or peltate-shaped plate, as especially seen in FIGS. 2 and 4. The apex of two symmetric sides of the triangular-shaped plate or the tip of the peltate-shaped plate is termed as the 'tip of the folding-shank anchor', which is helpful in reducing the drag force and soil resistance on the hybrid anchor 100 during free fall in the seawater and dynamic penetration in the seabed. Therefore, the fall velocity and penetration depth of the hybrid anchor 100 are increased during free fall in the seawater and dynamic penetration in the seabed. The thickness of the fluke 11 gradually decreases from the central line to the outer edge of the fluke, which results in a decrease of the frontal area of the folding-shank plate anchor 1 in a plane that is perpendicular to the central line of the hybrid anchor. This is beneficial in increasing the penetration depth of the hybrid anchor 100 in the seabed. The edges of the fluke 11 are round-grinded to reduce the drag force on the hybrid anchor 100 during free fall in the seawater, which helps to increase the fall velocity of the hybrid anchor 100 during free fall in the seawater and increase the penetration depth in the seabed.

The support 13 is fixed on the central line of the fluke 11 through screws, welding, etc. The position of the support 13 can be adjusted along the central line of the fluke 11.

The shank 12 has first and second ends: the first end is hinged to the support 13 through a pivot shaft 14, and the second end is free. A padeye 16 is set at the second end of the shank 12 to connect the mooring line 7. The shank 12 is further fixed to the support 13 by a shear pin (a) 15. When the shear pin (a) 15 is intact, the shank 12 is folded and is parallel to the central line of the fluke 11. When the shear pin (a) 15 is broken under the pullout load at the padeye 16, the shank 12 will rotate around the pivot shaft 14. The shank 12 is folded, as especially seen in FIG. 2, when the hybrid anchor 100 falls in the seawater and penetrates in the seabed. When the shank 12 is folded, the projected area of the shank 12 in the plane that is perpendicular to the central line of the fluke 11 becomes minimize, which is helpful in reducing the drag force and soil resistance acting on the shank 12. Therefore, the hybrid anchor 100 will gain higher velocity during free fall in the seawater and deeper penetration depth in the seabed. With a folding shank 12, the distance from the padeye 16 to the central line of the hybrid anchor 100 is reduced. A pull load in the upward direction, provided by the mooring line 7, will be acted on the padeye 16 when the hybrid anchor 100 falls in the seawater. By using a folding shank 12, the moment generated by the pull load of the mooring line relative the gravity center of the hybrid anchor 100 is significantly reduced, which is helpful in improving the directional stability of the hybrid anchor 100 during free fall in the seawater.

After dynamic penetration of the folding shank plate anchor 1, the shear pin (a) 15 is broken by tensioning the mooring line 7 connected at the padeye 16. Then the shank 12 can rotate around the pivot shaft 14 to an unfolded condition, as especially seen in FIG. 3. The shank rotation angle 19 is defined as the included angle from the central line of the shank 12 to that of the fluke 11. The maximum shank rotation angle 19 is 90 degrees, during which the shank 12 is perpendicular to the plane of the fluke 11. The unfolding process of the shank will increase the projected area of the folding-shank plate anchor 1 in the plane perpendicular to the uplift load at the padeye 16. The failure mechanism of the soil surrounding the folding-shank plate anchor 11 gradually translates to normal failure mechanism, which results in an increase of the holding capacity.

The rotation of the shank 12 is unidirectional, i.e. the shank 12 only rotates to an orientation outwards from the fluke 11. A braking device should be set between the shank 12 and the pivot shaft 14. For instance, a one-way bearing can be installed between the shank 12 and the pivot shaft 14, so that the second end of the shank 12 only rotates to an orientation outwards from the fluke 11.

The length of the shank 12 can be adjusted based on practical requirements. If the padeye 16 is lower than the centroid of the fluke 11, the folding-shank plate anchor 1 can dive in the seabed under certain conditions (i.e. by tensioning the mooring line 7, the folding-shank plate anchor 1 can dive into deeper, stronger soils to gain higher holding capacity).

The connecting bar 17 is fixed at the tail of the fluke 11, whose central line is coincide with that of the fluke 11. A horizontal hole (b) 18 is set on the connecting bar 17, which is sued to connect the ballast shaft 2.

Figure 5:
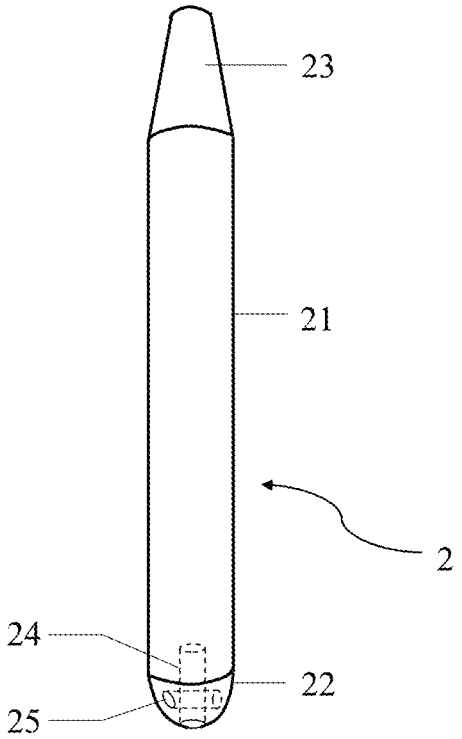
FIG. 5 shows a ballast shaft.

FIG. 5 shows the key structural elements of the ballast shaft 2, which is comprised of a semi-ellipsoidal tip 22, a cylindrical mid-shaft 21, and a circular-truncated-cone shaped tail 23. The three parts, semi-ellipsoidal tip, cylindrical mid-shaft, and circular-truncated-cone shaped tail, are connected sequentially by threads. The ballast shaft 2 is used to increase the total weight of the hybrid anchor 100, which helps the folding-shank plate anchor 1 to achieve enough penetration depth in the seabed. The cylindrical mid-shaft 21 has varied lengths to adjust the total weight of the hybrid anchor 100 based on practical requirements. For instance, a longer and heavier cylindrical mid-shaft 21 should be used to increase the total weight and hence the penetration depth of the hybrid anchor 100 in the seabed with relatively high strength. The cylindrical mid-shaft 21 is fabricated with hollow structure to fill high density materials (such as lead) in order to increase the total weight of the hybrid anchor 100. The cross section of the cylindrical mid-shaft 21 is a circle, which is convenient for fabrication. The semi-ellipsoidal tip 22 has a streamlined profile, hence the streamlines can smoothly flow from the folding-shank plate anchor 1 to the ballast shaft 2. The streamlined profile can reduce the drag force acting on the semi-ellipsoidal tip 22. The size of the cross section of the circular-truncated-cone shaped tail 23 gradually reduces in order to restrain the disturbance of the streamlines, and hence to reduce the drag force on the ballast shaft 2 when the hybrid anchor 100 falls in the seawater.

Figure 6:
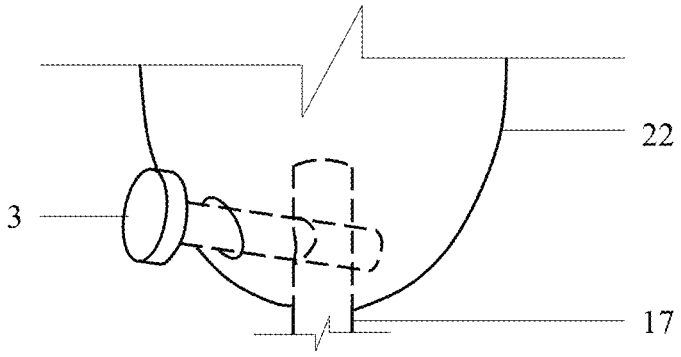
FIG. 6 shows a connection method between folding-shank plate anchor and ballast shaft.

The semi-ellipsoidal tip 21 has an axial slot 24 to accommodate the connecting bar 17 of the folding-shank plate anchor 1. FIG. 6 shows the connection between the ballast shaft 2 and the folding-shank plate anchor 1. The semi-ellipsoidal tip 22 further has a horizontal hole (a) 25, and the connecting bar 17 of the folding-shank plate anchor 1 further has a horizontal hole (b) 18. A shear pin (b) 3 is sealed in the horizontal hole (a) 25 and the horizontal hole (b) 18 to connect the ballast shaft 2 and the folding-shank plate anchor 1.

Figure 7:
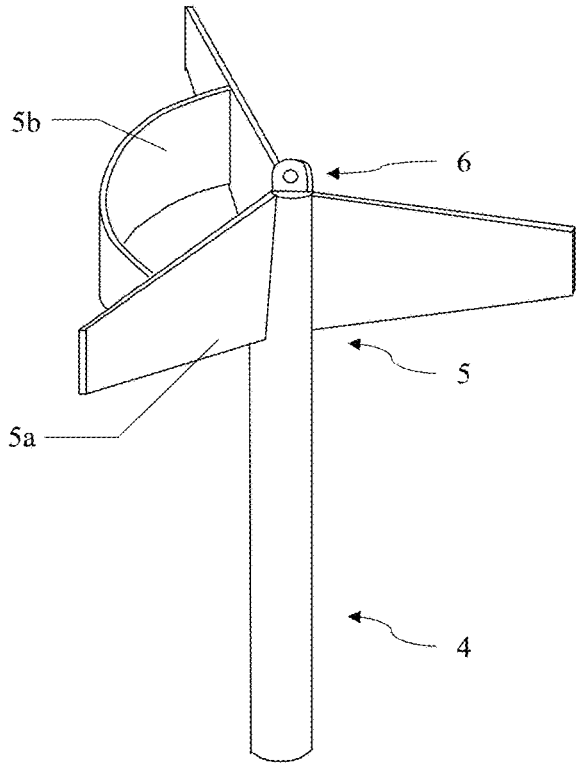
FIG. 7 shows an extension rod and rear fins.

FIG. 7 shows the key structural elements of the extension rod 4 and rear fins 5. The extension rod 4 has a cylindrical profile, whose cross section in size is the same with that of the minimum cross section of the circular-truncated-cone shaped tail 23 of the ballast shaft 2. The extension rod 4 is connected at the tail of the ballast shaft 2. At the tail of the extension rod 4, a recovery hole 6 is set to connect the retrieval line 8. The retrieval line 8 can be used to release the hybrid anchor 100 and retrieve the ballast shaft 2 and the above parts after dynamically installation. The extension rod 4 is fabricated from light-weight metal or plastic, and is further fabricated with hollow structure to lower the gravity center of the hybrid anchor 100. The extension rod 4 enlarges the distance from the rear fins 5 to the tip of the folding-shank plate anchor 1. Then the hydrodynamic center of the hybrid anchor 100 moves towards the anchor rear, which is beneficial in improving the directional stability of the hybrid anchor 100 during free fall in the seawater. The length of the extension rod 4 can be adjusted based on practical requirements. For instance, a longer extension rod 4 is required in the clayey seabed in order to avoid buckling failure of the rear fins 5 during the dynamic penetration process of the hybrid anchor 100 in the seabed.

The rear fins 5 are connected towards the rear of the extension rod 4, which are used to improve the directional stability of the hybrid anchor 100 during free fall in the seawater. The rear fins 5 further comprise a plurality of plate rear fins **5*a* and an arched rear fin 5*b*. Each plate rear fin 5*a*** is a quadrilateral thin plate. The upper edge of the plate rear fin is perpendicular to the central line of the extension rod 4, and the height of the plate rear fin reduces from the inner side to the outer side. The least number of the plate rear fins 5*a* is 3, and are attached towards the rear of the extension rod 4 to improve the directional stability of the hybrid anchor 100 during free fall in the seawater.

The arched rear fin 5*b* is connected between two pieces of plate rear fins 5*a* in an orientation opposite the shank 12. During free fall in the seawater, the moment generated by the drag force on the arched rear fin 5*b* relative to the gravity center of the hybrid anchor 100 balances the moment generated by the pull load on the mooring line 7 relative to the gravity center of the hybrid anchor 100, so that the verticality of the hybrid anchor 100 during free fall in the seawater is ensured. The radius and radian of the arched rear fin 5*b* are associated with the material and diameter of the mooring line 7, the release height of the hybrid anchor 100 in the seawater and many other factors. Hence the size of the arched rear fin 5*b* should be adjusted based on practical requirements.

The plate rear fins 5 are fabricated from light-weight metal or plastic to lower the gravity center of the hybrid anchor 100.

The central lines of the extension rod 4, the ballast shaft 2, and the folding-shank plate anchor 1 are collinear. The gravity center of the hybrid anchor 100 should be lower than the hydrodynamic center of the hybrid anchor 100 to keep directional stability during free fall in the seawater. Enlarging the height of the extension rod 4 or the width of the plate rear fin 5*a* can move the hydrodynamic center of the hybrid anchor 100 towards the anchor rear. Moreover, the gravity center of the hybrid anchor 100 is lowered by increasing the density of the cylindrical mid-shaft 21 of the ballast shaft 2 and reducing the density of the extension rod 4. The above measures are all useful in improving the directional stability of the hybrid anchor 100 during free fall in the seawater.

2. Method of Installing the Hybrid Anchor

Figure 8A:
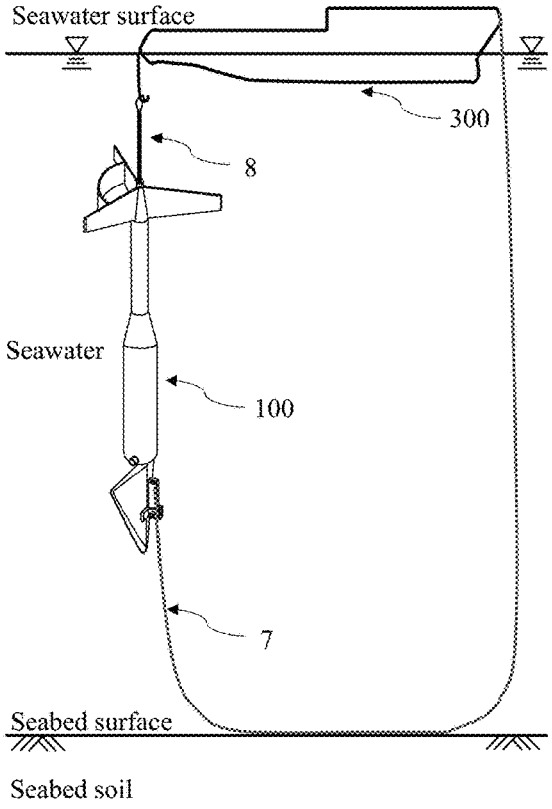
FIG. 8*a* illustrates a first stage of installing the hybrid anchor.
Figure 8B:
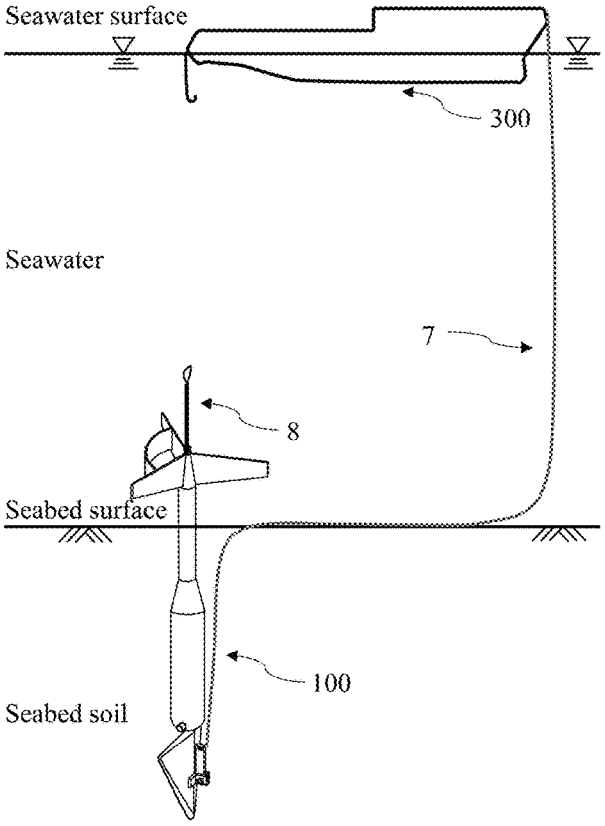
FIG. 8*b* illustrates a second stage of installing the hybrid anchor.

FIGS. 8*a*-8*b* show the five stages installing the hybrid anchor 100.

FIG. 8*a* shows the first stage installing the hybrid anchor 100. First, fix the shank 12 to the support 13 by the shear pin (a) 15, and connect the folding-shank plate anchor 1 and the ballast shaft 2 by the shear pin (b) 3. Then release the hybrid anchor 100 from the installation vessel 300 to the seawater until a pre-determined height above the seabed, and subsequently release the mooring line 7 connected at the padeye 16 to the seabed. In the following, keep the hybrid anchor 100 steady in the seawater until the sway amplitude of the hybrid anchor is stable.

FIG. 8*b* shows the second stage installing the hybrid anchor 100. Release the retrieval line 8 connected at the recovery hole 6 to allow the hybrid anchor 100 to fall in the seawater and penetrate into the seabed.

Figure 8C:
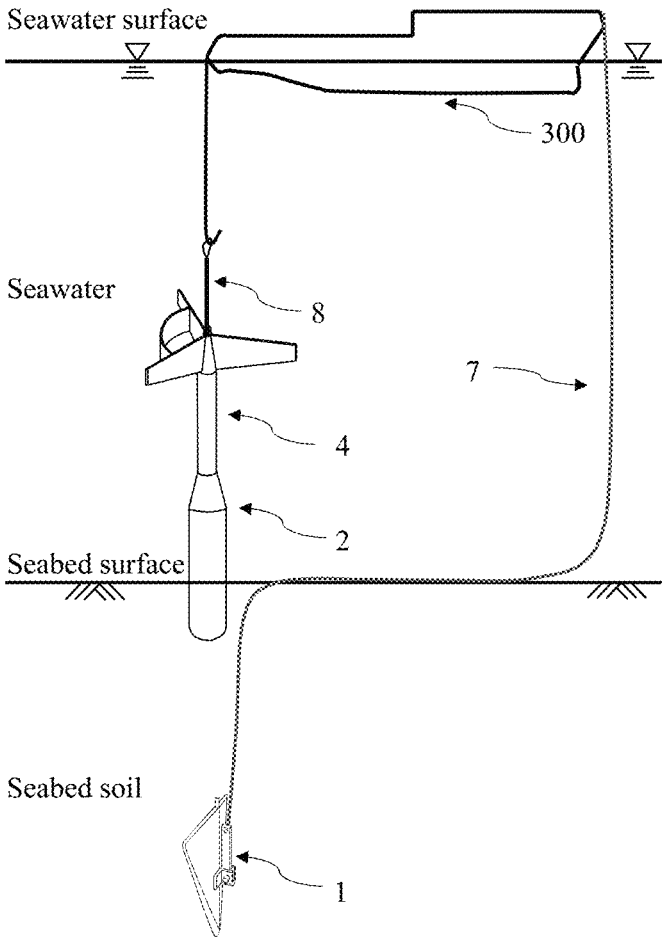
FIG. 8*c* illustrates a third stage of installing the hybrid anchor.

FIG. 8*c* shows the third stage installing the hybrid anchor 100. Tension the retrieval line 8 connected at the recovery hole 6 after dynamically installation of the hybrid anchor 100, and the shear pin (b) 3 is broken when the shear force exceeds the allowable shear force to allow separation between the ballast shaft 2 and the folding-shank plate anchor 1. Then further tension the retrieval line 8 to retrieve the ballast shaft 2 and the other parts above the ballast shaft to the installation vessel 300, and only the folding-shank plate anchor 1 is left in the seabed.

Figure 8D:
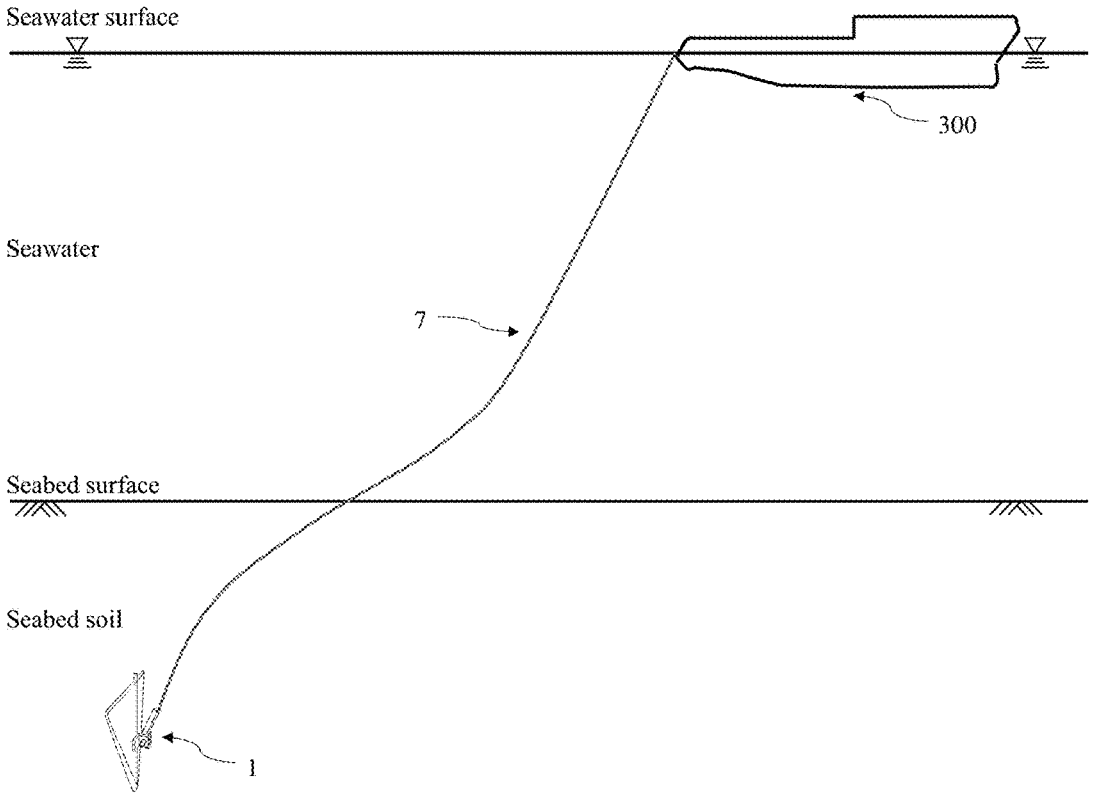
FIG. 8*d* illustrates a fourth stage of installing the hybrid anchor.

FIG. 8*d* shows the fourth stage installing the hybrid anchor 100. Tension the mooring line 7 connected at the padeye 16, and the shear pin (a) 15 is broken when the shear force exceeds the allowable shear force. Then the shank 12 can rotate freely around the pivot shaft 14.

Figure 8E:
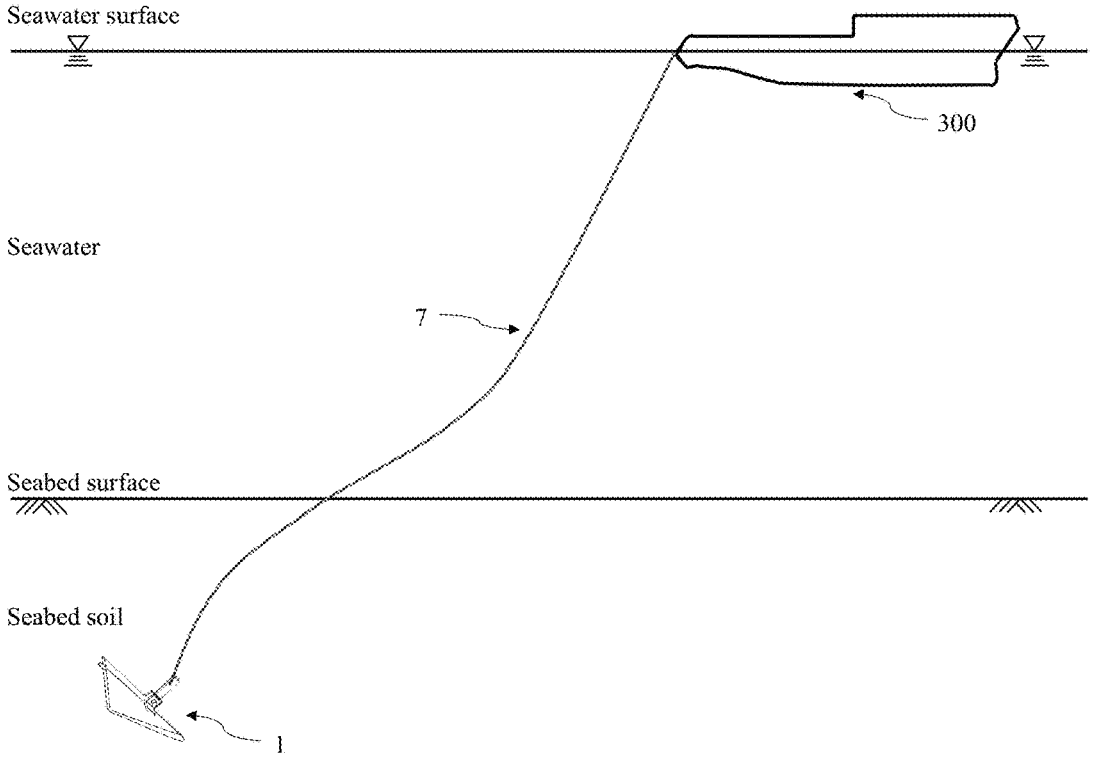
FIG. 8*e* illustrates a final stage of installing the hybrid anchor.

FIG. 8*e* shows the final stage installing the hybrid anchor 100. Further tension the mooring line 7 connected at the padeye 16 to enlarge the shank rotation angle 19, and the fluke 11 starts to rotate in the seabed until the pullout load achieves the designed load. The projected area of the folding-shank plate anchor 1 in the plane perpendicular to the uplift load at the padeye 16 increases with the rotation of the fluke 11, and the failure mechanism of the soil surrounding the folding-shank plate anchor 1 gradually translates to normal failure mechanism. The rotation of the fluke 11 in the seabed will result in an improvement of the holding capacity.

The folding-shank plate anchor 1 and the ballast shaft 2 are connected by a shear pin (b) 3, whose allowable shear force is 1.5~2.0 times the dry weight of the folding-shank plate anchor 1. The shear pin (b) 3 should provide enough shear force to ensure that the folding-shank plate anchor 1 is not separated from the ballast shaft 2 during the release process of the hybrid anchor 100 in the seawater. Moreover, the shear pin (b) 3 should be easily to break when retrieving the ballast shaft 2, during which the folding-shank plate anchor 1 is not pulled out together with the ballast shaft 2. The ballast shaft 2 and the other parts above the ballast shaft are re-usable for subsequent installation of folding-shank plate anchors 1. The reusable design of the ballast shaft 2 and the above parts only not ensures the folding-shank plate anchor 1 to achieve enough penetration depth in the seabed, but also lowers the fabrication cost. In an anchoring system, all the folding-shank plate anchors can be installed by only using one ballast shaft 2.

Figure 9:
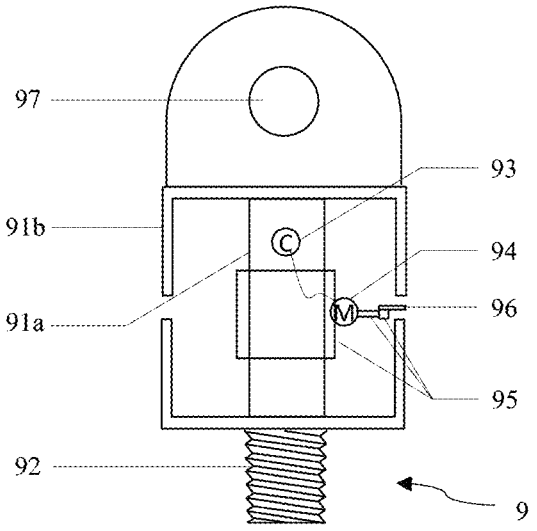
FIG. 9 shows a main view of the active-control system.

3. Control Method for Keeping Verticality of Hybrid Anchor During Free Fall in Seawater FIG. 9 shows the key structural elements of the active-control system 9, which is used to keep the verticality of the hybrid anchor during free fall in the seawater. The active-control system 9 is comprised of an equipment chamber 91, an active-control unit 93, an electric motor 94, an actuator 95 (including an axial sub-actuator 95*a*, an annular sub-actuator 95*b*, and a rotational sub-actuator 95*c*), and a mini-plate 96.

Figure 10:
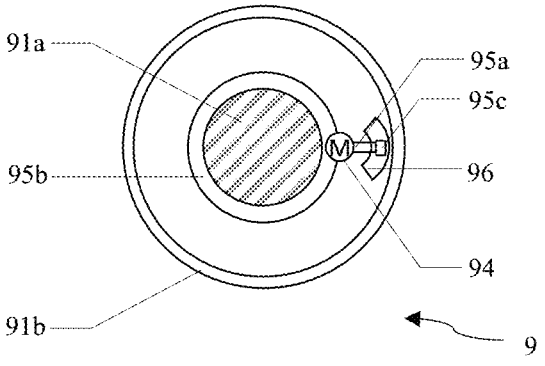
FIG. 10 shows a top view of the active-control system.

The equipment chamber 91 further comprises a cylindrical shaft 91*a* and a thin-wall cylinder 91*b* fixed outside the cylindrical shaft 91*a*, and the central line of the cylindrical shaft is coincide with that of the thin-wall cylinder. The thin-wall cylinder 91*b* has a cycle of annular gap located at the middle height of the thin-wall cylinder. The position of the mini-plate 96 is flush with the annular gap located at the middle height of the thin-wall cylinder 91*b*. The bottom of the equipment chamber 91 is connected to the tail of the hybrid anchor 100 by threads, and the top of the equipment chamber 91 has a recovery hole (n) 97 to connect the retrieval line 8. FIG. 10 shows the cross sectional view of the active-control system 9.

The active-control unit 93 is sealed inside the cylindrical shaft of the equipment chamber 91, comprising an accelerometer module, a gyroscope module, a micro-controller, and a driver module. The accelerometer module and the gyroscope module measure accelerations and angular velocities of the hybrid anchor during free fall in the seawater. The micro-controller calculates the tilt angle from the central line of the hybrid anchor to the vertical direction in real time and makes adjustment solutions based on the measurements from the accelerometer module and the gyroscope module, and then sends the adjustment solution to the driver module.

The electric motor 94 is connected to the active-control unit 93, which forces the actuator 95 to move based on the command from the driver module.

The actuator 95 comprises an axial sub-actuator 95*a*, an annular sub-actuator 95*b*, and a rotational sub-actuator 95*c*. The annular sub-actuator 95*b* is fixed to the cylindrical shaft of the equipment chamber 91. The axial sub-actuator 95*a* has first and second ends, and the first end of the axial sub-actuator is fixed to the annular sub-actuator 95*b*. The central line of the axial sub-actuator is perpendicular to that of the equipment chamber 91. The rotational sub-actuator 95*c* is fixed to the second end of the axial sub-actuator 95*a*.

The mini-plate 96 is fixed to the rotational sub-actuator 95*c*. The electric motor 94 acts under the command of the driving module and adjusts the positions and postures of the mini-plate 96 through the actuator 95.

Figure 11A:
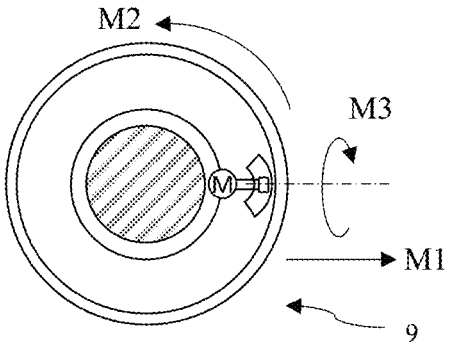
FIG. 11*a* shows motion states of the mini-plate in the active-control system.
Figure 11B:
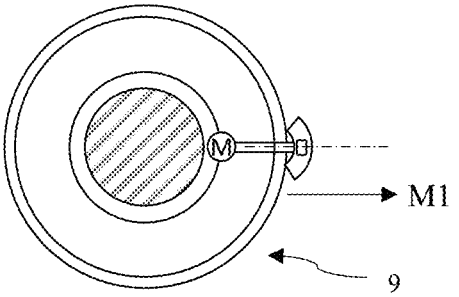
FIG. 11*b* shows a translational movement of the mini-plate.
Figure 11C:
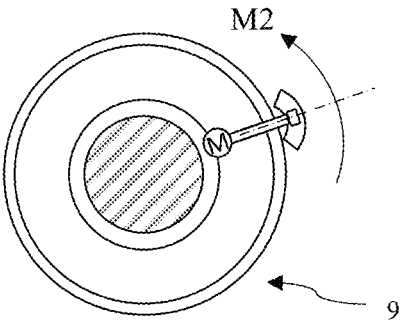
FIG. 11*c* shows a circumferential rotation motion of the mini-plate.
Figure 11D:
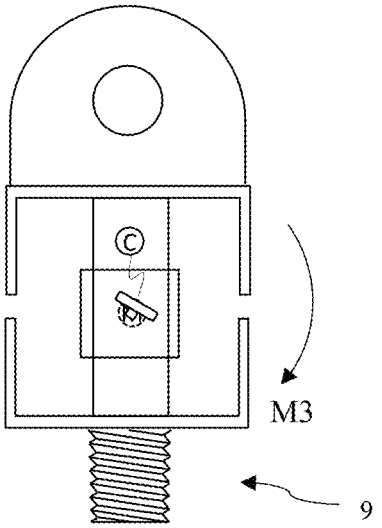
FIG. 11*d* shows a rotational movement of the mini-plate.

FIG. 11*a* illustrates the motion states for the mini-plate 96, including a translation along a direction perpendicular to the central line of the hybrid anchor, a rotation around the central line of the hybrid anchor, and a rotation around the central line of the mini-plate itself. As shown in FIG. 11*b*, the axial sub-actuator 95*a* makes the mini-plate 96 to move along a direction perpendicular to the central line of the hybrid anchor (M1), the annular sub-actuator 95*b* makes the mini-plate 96 to rotate around the central line of the hybrid anchor (M2), and the rotational sub-actuator 95*c* makes the mini-plate 96 to rotate around the central line of the mini-plate itself (M3).

The mini-plate 96 is not exposed outside of the thin-wall cylinder 91*b* of the equipment chamber when the loading displacement of the axial sub-actuator 95*a* is zero, hence the mini-plate 96 is not subjected to drag force when the hybrid anchor falls in the seawater. The mini-plate 96 stretches out from the annular gap of the thin-wall cylinder 91*b* when the axial sub-actuator 95*a* moves, then the mini-plate 96 is subjected to drag force when the hybrid anchor falls in the seawater. The drag force on the mini-plate can be used to adjust the verticality of the hybrid anchor during free fall in the seawater.

Accordingly, a control method to keep verticality of the hybrid anchor 100 during free fall in the seawater by using the active-control system 9, comprising the following steps:

(1) screw the active-control system 9 to the tail of the hybrid anchor 100;

the accelerometer module and the gyroscope module in the active-control unit 93 measure the accelerations and angular velocities of the hybrid anchor during free fall in the seawater in real time; and the micro-controller calculate the tilt angle from the central line of the hybrid anchor to the vertical direction in real time based on acceleration data from the accelerometer module and angular velocity data from the gyroscope module;

(2) the micro-controller makes adjustment solution to the driver module when the tilt angle from the central line of the hybrid anchor to the vertical direction exceeds a pre-determined threshold value; and the electric motor 94 acts under the command of the driving module and adjusts the positions and postures of the mini-plate 96 through the actuator 95;

(3) the mini-plate 96 moves and rotates under the control of the actuator 95, and is subjected to drag force when the hybrid anchor falls in the seawater, and a moment is generated by the drag force on the mini-plate relative to a gravity center of the hybrid anchor, which forces the central line of the hybrid anchor to adjust to the vertical direction;

(4) the active-control system 9 monitors the tilt angle from the central line of the hybrid anchor to the vertical direction and drives the mini-plate 96 to move and rotate in real time in order to ensure the verticality of the hybrid anchor during free fall in the seawater.

Two embodiments are disclosed herein to describe the application of the active-control system 9 to DIAs.

Figure 12A:
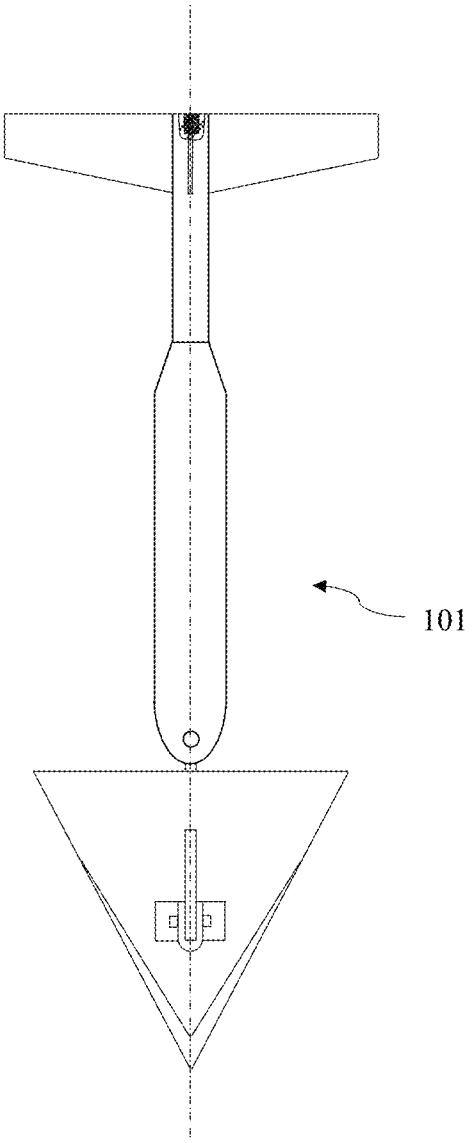
FIG. 12*a* shows a hybrid anchor without recovery hole.
Figure 12B:
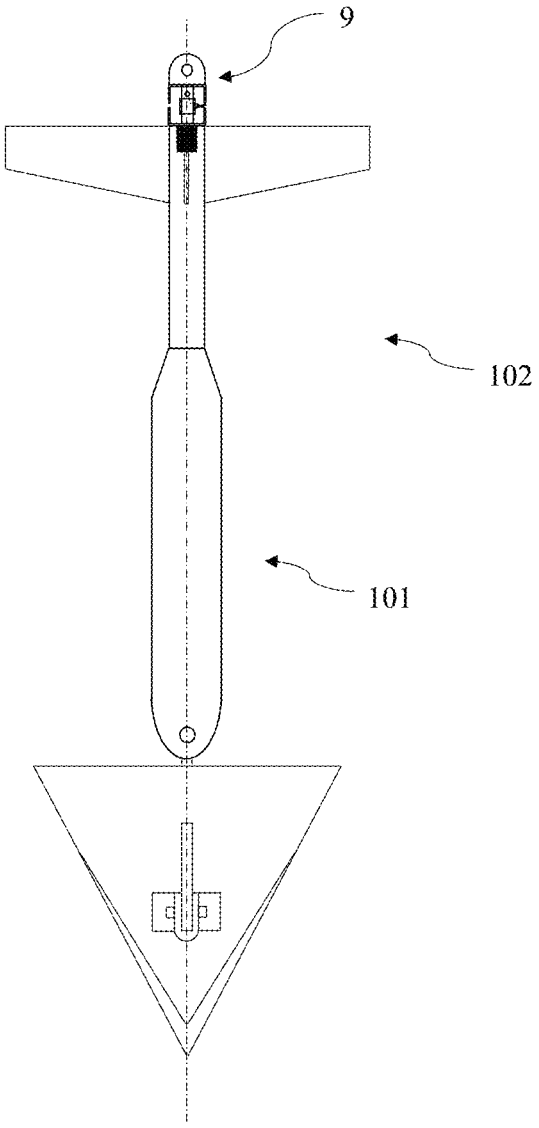
FIG. 12*b* shows a hybrid anchor with an active-control system.

FIG. 12*a* is a hybrid anchor without recovery hole 101. Internal threads, which are matched with the external threads 92 of the active-control system 9, are set at the tail of the extension rod 4 of the hybrid anchor without recovery hole 101. The hybrid anchor without recovery hole 101 and the active-control system 9 are connected by threads. FIG. 12*b* show a hybrid anchor with an active-control system 102. The recovery hole (n) 97 at the tail of the active-control system 9 can be used to connect the retrieval line 8. The methods installing the hybrid anchor with an active-control system 102 are the same with that of the hybrid anchor 100.

Figure 13A:
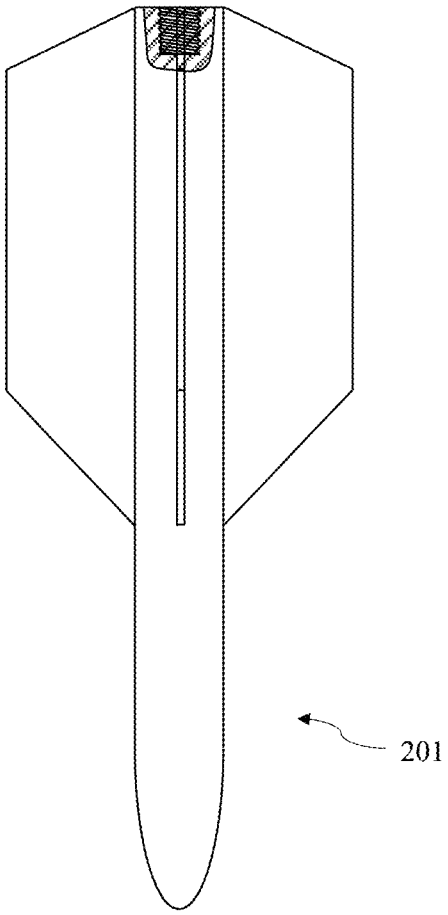
FIG. 13*a* shows a torpedo-shaped DIA without recovery hole.
Figure 13B:
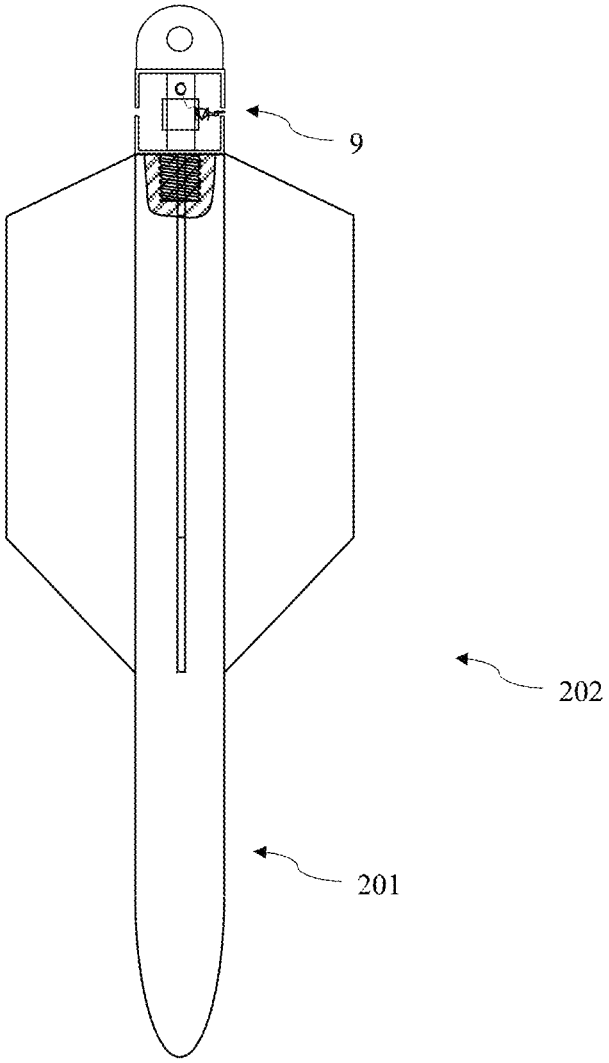
FIG. 13*b* shows a torpedo-shaped DIA with an active-control system.

FIG. 13*a* is a torpedo-shaped DIA 200, and FIG. 13*b* is a torpedo-shaped DIA without recovery hole 201. Internal threads, which are matched with the external threads 92 of the active-control system 9, are set at the tail of the torpedo-shaped DIA without recovery hole 201. FIG. 13*b* also shows a torpedo-shaped DIA with an active-control system 202. The recovery hole (n) 97 at the tail of the active-control system 9 can be used to connect the mooring line 7. The methods installing the torpedo-shaped DIA with an active-control system 202 are the same with that disclosed previously.

In the above embodiments, the diameter of the thin-wall cylinder 91*b* in the active-control system 9 is equal to that of the extension rod 4 of the hybrid anchor without recovery hole 101 and that of the shaft of the torpedo-shaped DIA 201.

The active-control system 9 is not only suitable to be used for hybrid anchors 101 and torpedo-shaped DIAs 201, but also suitable for other types of DIAs (such as the plate-shaped DIA). Moreover, the active-control system 9 is also suitable to be used to rectify the verticality of other free fall projectiles in offshore engineering.

The above descriptions are merely two specific embodiments, but protection scope of the present invention is not limited thereto. Any familiar changes with the art in the technical scope disclosed by the present invention are considered within the protection scope of the present invention.

The invention claimed is:

1. A hybrid dynamically installed anchor with a folding shank, comprising a folding-shank plate anchor, a ballast shaft, an extension rod, a plurality of rear fins, and a recovery hole from a front end to a tail end of the hybrid dynamically installed anchor;

said folding-shank plate anchor is used to provide holding capacity, said ballast shaft is used to force the folding-shank plate anchor to achieve an enough penetration depth in a seabed, and said extension rod and rear fins are used to improve a directional stability of the hybrid dynamically installed anchor during free fall in a seawater;

said folding-shank plate anchor further comprises a fluke, a shank, a support, and a connecting bar;

said fluke is a symmetric triangular-shaped or peltate-shaped plate, with a thickness decreasing from a central line to an edge of the fluke; and the edge of the fluke is round-grinded to reduce a drag force on the hybrid dynamically installed anchor during free fall in the seawater and a soil resistance on the hybrid dynamically installed anchor during dynamically penetration in the seabed;

said support is fixed on a central line of the fluke;

said shank has a first end and a second ends, the first end of the shank is hinged to the support through a pivot shaft, and the second end of the shank is free;

said second end of the shank has a padeye to connect a mooring line;

said shank is further fixed to the support by a shear pin (a), the shank is folded and is parallel to the central line of the fluke when the shear pin (a) is intact, and the shank rotates around the pivot shaft when the shear pin (a) is broken under a pullout load at the padeye;

a one-way bearing is installed between the shank and the pivot shaft, so that the second end of the shank only rotates to an orientation outwards from the fluke;

said connecting bar is fixed at a tail of the fluke, and a central line of the connecting bar is collinear with the central line of the fluke;

said ballast shaft further comprises a semi-ellipsoidal tip, a cylindrical mid-shaft, and a circular-truncated-cone shaped tail, wherein the semi-ellipsoidal tip, the cylindrical mid-shaft, and the circular-truncated-cone shaped tail are connected through threads;

said cylindrical mid-shaft of the ballast shaft has varied lengths to adjust a total weight of the hybrid dynamically installed anchor, so that the hybrid dynamically installed anchor achieves an enough penetration depth in the seabed;

said semi-ellipsoidal tip of the ballast shaft has an axial slot to accommodate the connecting bar of the folding-shank plate anchor;

said semi-ellipsoidal tip of the ballast shaft further has a horizontal hole (a), and the connecting bar of the folding-shank plate anchor further has a horizontal hole (b), and a shear pin (b) is sealed in the horizontal hole (a) and the horizontal hole (b) to connect the ballast shaft and the folding-shank plate anchor;

said extension rod has a cylindrical profile, and the extension rod enlarges a distance from the rear fins to a tip of the folding-shank plate anchor to keep the directional stability of the hybrid dynamically installed anchor during free fall in the seawater;

said extension rod further has first and second ends;

the first end of the extension rod is connected to a tail of the ballast shaft, and the second end of the extension rod has a recovery hole to connect a retrieval line;

said rear fins further comprise a plurality of plate rear fins and an arched rear fin, and are connected towards a rear of the extension rod and below the recovery hole to keep the directional stability of the hybrid dynamically installed anchor during free fall in the seawater;

the extension rod and rear fins are fabricated from lightweight materials, and the extension rod is further fabricated with hollow structure to lower a gravity center of the hybrid dynamically installed anchor;

a central line of the extension rod, a central line of the ballast shaft, and a central line of the folding-shank plate anchor are collinear;

the gravity center of the hybrid dynamically installed anchor is lower than a hydrodynamic center of the hybrid dynamically installed anchor to keep directional stability during free fall in the seawater.

2. The hybrid dynamically installed anchor with a folding shank according to claim 1, wherein said shank rotates around the pivot shaft when the shear pin (a) is broken under a pullout load acting on the padeye, and a maximum rotation angle from a central line of the shank to a central line of the fluke is 90 degrees; and a holding capacity of the hybrid dynamically installed anchor improves with a rotation of the shank.

3. The hybrid dynamically installed anchor with a folding shank according to claim 1, wherein an allowable shear force of the shear pin (b) is 1.5~2.0 times a dry weight of the folding-shank plate anchor.

4. The hybrid dynamically installed anchor with a folding shank according to claim 1, wherein a least number of the plate rear fins is 3, and the plate rear fins are equidistantly attached towards the rear of the extension rod; the directional stability of the hybrid dynamically installed anchor during free fall in the seawater is improved by enlarging a width of the plate rear fins; said plate rear fin is a quadrilateral thin plate, and an upper edge of the plate rear fin is perpendicular to the central line of the extension rod, and a height of the plate rear fin reduces from an inner side to an outer side to reduce a drag force on the plate rear fin when the hybrid dynamically installed anchor falls in the seawater.

5. The hybrid dynamically installed anchor with a folding shank according to claim 1, wherein the arched rear fin is connected between two pieces of plate rear fins in an orientation opposite the shank; a moment generated by a drag force on the arched rear fin relative to the gravity center of the hybrid dynamically installed anchor balances a moment generated by a drag force on the mooring line connected to the padeye relative to the gravity center of the hybrid dynamically installed anchor, so that a verticality of the hybrid dynamically installed anchor during free fall in the seawater is ensured.

6. A control method for keeping verticality of the hybrid dynamically installed anchor with a folding shank of claim 1 during free fall in the seawater, wherein an active-control system sealed in the hybrid dynamically installed anchor comprises an equipment chamber, an active-control unit, an electric motor, an actuator, and a mini-plate;

said equipment chamber comprises a cylindrical shaft and a thin-wall cylinder fixed outside the cylindrical shaft, and a central line of the cylindrical shaft and a central line of the thin-wall cylinder are collinear; said thin-wall cylinder has a cycle of annular gap located at a middle height of the thin-wall cylinder;

a bottom of the equipment chamber is connected to the tail end of the hybrid dynamically installed anchor by threads, and a top of the equipment chamber has a recovery hole (n) to connect a retrieval line;

said active-control unit is sealed inside the cylindrical shaft of the equipment chamber, comprising an accelerometer module, a gyroscope module, a micro-controller, and a driver module; the accelerometer module and the gyroscope module measure accelerations and angular velocities of the hybrid dynamically installed anchor during free fall in the seawater, and the micro-controller calculates a tilt angle from a central line of the hybrid dynamically installed anchor to a vertical direction in real time and makes an adjustment solution based on measurements from the accelerometer module and the gyroscope module, and sends the adjustment solution to the driver module;

said electric motor is connected to the active-control unit, and the electric motor forces the actuator to move based on a command from the driver module;

said actuator comprises an axial sub-actuator, an annular sub-actuator, and a rotational sub-actuator; the annular sub-actuator is fixed to the cylindrical shaft of the equipment chamber; the axial sub-actuator has first and second ends, wherein a first end of the axial sub-actuator is fixed to the annular sub-actuator, and a central line of the axial sub-actuator is perpendicular to a central line of the equipment chamber; and the rotational sub-actuator is fixed to a second end of the axial sub-actuator;

said mini-plate is fixed to the rotational sub-actuator, and a position of the mini-plate is flush with the annular gap located at the middle height of the thin-wall cylinder; the electric motor acts under a command of the driving module and adjusts a position and a posture of the mini-plate through the actuator;

said mini-plate has three motion states, comprising a translation along a direction perpendicular to a central line of the hybrid dynamically installed anchor, a rotation around the central line of the hybrid dynamically installed anchor, and a rotation around a central line of the mini-plate itself; the axial sub-actuator makes the mini-plate to move along a direction perpendicular to the central line of the hybrid dynamically installed anchor, the annular sub-actuator makes the mini-plate to rotate around the central line of the hybrid dynamically installed anchor, and the rotational sub-actuator makes the mini-plate to rotate around the central line of the mini-plate itself;

the mini-plate is not exposed outside of the thin-wall cylinder of the equipment chamber when a loading displacement of the axial sub-actuator is zero, and the mini-plate is not subjected to drag force when the hybrid dynamically installed anchor falls in the seawater; and the mini-plate stretches out from the annular gap of the thin-wall cylinder when the axial sub-actuator moves, and the mini-plate is subjected to drag force when the hybrid dynamically installed anchor falls in the seawater to adjust the verticality of the hybrid dynamically installed anchor;

the control method for keeping verticality of the hybrid dynamically installed anchor with a folding shank, comprising following steps:

(1) screw the active-control system to the tail end of the hybrid dynamically installed anchor; the accelerometer module and the gyroscope module measure accelerations and angular velocities of the hybrid dynamically installed anchor during free fall in the seawater in real time; and the micro-controller calculate the tilt angle from the central line of the hybrid dynamically installed anchor to the vertical direction in real time based on acceleration data from the accelerometer module and angular velocity data from the gyroscope module;

(2) the micro-controller makes adjustment solution to the driver module when the tilt angle from the central line of the hybrid dynamically installed anchor to the vertical direction exceeds a pre-determined threshold value; and the electric motor acts under a command of the driving module and adjusts a position and a posture of the mini-plate through the actuator;

(3) the mini-plate moves and rotates under the control of the actuator, and is subjected to drag force when the hybrid dynamically installed anchor falls in the seawater, and a moment is generated by a drag force on the mini-plate relative to a gravity center of the hybrid dynamically installed anchor, which forces the central line of the hybrid dynamically installed anchor to adjust to the vertical direction;

(4) the active-control system monitors the tilt angle from the central line of the hybrid dynamically installed anchor to the vertical direction and drives the mini-plate to move and rotate in real time to keep verticality of the hybrid dynamically installed anchor during free fall in the seawater.

7. The control method for keeping verticality of the hybrid dynamically installed anchor with a folding shank during free fall in the seawater according to claim 6, wherein said control method is suitable to be applied to other types of dynamically installed anchors and free fall penetrometers.

* * * * *